US006837985B2

(12) United States Patent
Fairbourn et al.

(10) Patent No.: US 6,837,985 B2
(45) Date of Patent: Jan. 4, 2005

(54) EXTERNAL COUNTER ELECTRODE

(75) Inventors: David C. Fairbourn, Sandy, UT (US); Max E. Sorenson, Salt Lake City, UT (US)

(73) Assignee: Aeromet Technologies, Inc., Sandy, UT (US)

( * ) Notice: Subject to any disclaimer, the term of this patent is extended or adjusted under 35 U.S.C. 154(b) by 340 days.

(21) Appl. No.: 10/127,628

(22) Filed: Apr. 22, 2002

(65) Prior Publication Data

US 2002/0108868 A1 Aug. 15, 2002

Related U.S. Application Data

(63) Continuation of application No. 09/962,552, filed on Sep. 25, 2001, now Pat. No. 6,645,365, which is a continuation-in-part of application No. 09/398,859, filed on Sep. 20, 1999, now Pat. No. 6,294,072.

(51) Int. Cl.[7] ..... C25F 5/00
(52) U.S. Cl. ..... 205/706; 205/717; 204/248
(58) Field of Search ..... 205/706, 717; 204/248

(56) References Cited

U.S. PATENT DOCUMENTS

| | | | | |
|---|---|---|---|---|
| 3,600,245 A | | 8/1971 | Gates | 156/22 |
| 3,649,491 A | | 3/1972 | Bowers et al. | 204/146 |
| 3,984,295 A | | 10/1976 | Kametani et al. | 204/107 |
| 4,397,721 A | | 8/1983 | Exalto et al. | 204/144 |
| 4,406,761 A | | 9/1983 | Shimogori et al. | 204/144.5 |
| 4,544,462 A | | 10/1985 | Furutani et al. | 204/129 |
| 4,588,488 A | | 5/1986 | Sumita et al. | 204/145 |
| 5,028,304 A | | 7/1991 | Stanishevsky et al. | 204/129.75 |
| 6,645,365 B2 | * | 11/2003 | Fairbourn et al. | 205/706 |

FOREIGN PATENT DOCUMENTS

| | | |
|---|---|---|
| EP | 0430893 | 6/1991 |
| JP | 63313610 | 12/1988 |

OTHER PUBLICATIONS

USS. Assoc. of Iron and Steel Engineers, *The Making, Shaping and Treating of Steel*, pp 1084–1095, 1985, Pittsburgh, Penn., (no month).

* cited by examiner

*Primary Examiner*—Arun S. Phasge
(74) *Attorney, Agent, or Firm*—Wood, Herron & Evans, LLP

(57) ABSTRACT

A system and process for cleaning a hollow interior or a passageway of a metal member including an external container having counter electrode material with a higher potential than the metal member with the counter electrode material being dc coupled to the metal member, and electrolyte passing through the container to contact the counter electrode material and fluidicly coupled into the hollow interior or the passageway of the metal member to clean same.

48 Claims, 6 Drawing Sheets

EXTERNAL COUNTER ELECTRODE

CROSS REFERENCE TO RELATED APPLICATIONS

This application is a continuation of U.S. patent application Ser. No. 09/962,552 filed Sep. 25, 2001 and entitled CHEMICAL MILLING, now U.S. Pat. No. 6,645,365, which is a continuation-in-part of U.S. patent application Ser. No. 09/398,859 filed Sep. 20, 1999 and entitled REMOVAL OF METAL OXIDE SCALE FROM METAL PRODUCTS, now U.S. Pat. No. 6,294,072, the disclosures of both of which are incorporated herein by reference in their entireties as if completely set forth herein below.

BACKGROUND AND SUMMARY OF THE INVENTION

The present invention relates to chemical milling for removal of a portion of the metal surface of a monolithic metal product.

Chemical milling is often employed to remove a thin skin or layer of the parent metal from the outermost surface of a monolithic metal product so as to provide a desired surface finish or thickness of the metal product. To that end, as used herein, "monolithic metal product" is a reference to a metal member that has a generally homogeneous metal composition, at least through a substantial depth from the surface, where a portion or skin layer of the metal composition is to be removed while leaving behind a surface layer of essentially that same metal composition. In that context, chemical milling refers to a process for the selective and controlled removal of a depth of metal from the surface of a monolithic metal product through the use of chemical etchants so as to expose as a new "surface" a portion of the monolithic metal product that was below, and otherwise integrally part of, the original, and now removed layer or skin. Typically, the thickness or skin layer of metal removed during such a chemical milling process is on the order of 1–50 mils, wherein the depth of the monolithic metal member from which the skin layer is to be removed is typically substantially thicker, such as on the order of several times thicker to as much as several orders of magnitude thicker. Chemical milling may be thus used for most any type of metal for such purposes as achieving certain tolerances, removal of sub-surface impurities in the metal, and elimination of surface microcracks.

Where chemical milling is employed to improve the surface finish as above described, it has been the typical practice to employ highly concentrated baths containing acid or salt mixtures at very high temperatures. It would be desirable to utilize lower concentration baths and at reduced temperatures for the chemical etchant used in chemical milling processes without adversely affecting metal removal rates. In my aforementioned patent application, I teach that an oxide layer, known as a mill scale layer, may be removed from the surface of a monolithic metal product such as a steel sheet or steel bar, for example, with a low temperature electrolyte bath of a dilute solution of acid or base or mineral salts in water. In the process disclosed in my aforementioned patent application, referred to as a pickling process, the metal product is dc coupled to a separate counter electrode having a higher potential (E°) than that of the metal product from which the mill scale layer is to be stripped, and the metal and counter electrode are immersed in or otherwise associated with an electrolyte bath of relatively weak (diluted) acids or bases, at relatively lower temperatures and without imposition of an external positive voltage from the electrode to the metal structure. That process causes removal of the mill scale, at least in part, because a skin layer or portion of the surface of the monolithic metal product is itself removed in the process thereby freeing the mill scale from the surface. Hence, the pickling process there-described is an example of chemical milling.

The present invention provides chemical milling of a monolithic metal product not only for removal of mill scale in accordance with my prior application, but for providing a desired surface finish to or thickness of the monolithic metal product previously provided by chemical milling processes but without the use of the highly concentrated and/or high temperature acids previously used. Rather, as described in my prior application, a monolithic metal product and a separate counter electrode having an E° higher than that of the metal product are exposed to a low temperature bath of diluted acid or base solution and dc coupled without imposition of an external positive voltage for a time to cause a skin layer of the surface to be chemically milled therefrom to provide a desired surface finish or thickness of the metal product. Where there is also an impurity or undesired layer atop the monolithic metal product surface, that impurity is also washed away with the skin layer removed by the chemical milling. Thus, mill scale is removed, for example, from iron and steel products.

In accordance with a further feature of the present invention, non-metallic impurities or deposits may also be removed from the monolithic metal product surface by chemical milling with the above process. More particularly, and by way of example, it is a common problem in boiler tube systems, such as used in steam and power generating plants, that a scale or deposit of non-metallic compounds, such as carbonates, sulfonates, or other chemicals, will build up inside the boiler tubes from the high temperature water passing therethrough. The flow rate of the water begins to slow and can even become blocked off in some of the tubes. In order to repair such boiler tubes, it has been the practice to actually cut out complete sections of boiler-tube wall containing the clogged tubes, and replace the section with a new section of new, fully clear tubes. That process is costly, painstakingly slow, and fraught with dangers and problems for those who perform such work. With the chemical milling of the present invention, a dilute, low temperature acid or base electrolyte may be introduced into the partially clogged tubes, with the tube walls dc coupled to a higher E° counter electrode which is also exposed to the electrolyte. The result is to chemically mill a skin layer of the interior surface of the tubes, thereby also freeing the scale or deposit adhered to the skin layer. The skin layer and impurities may then be flushed out of the tubes along with the electrolyte. Simultaneously, dilute acid may be used to dissolve an element such as a carbonate.

One prior mill scale removal method discussed in Sumita et al. U.S. Pat. No. 4,588,488 proposes to reduce the temperatures and concentrations used in the pickling process for steel with an electron injection method based on cathodic polarization. In this method, a platinum electrode and steel part are immersed in a wash liquid containing an electrolyte, a pH regulating agent and a complexing agent. The positive cathode of an external dc power source is coupled to the electrode, and the negative anode is coupled to the steel. By imposing a positive voltage across the electrode to the steel, the oxide layer is said to be brought into an unstable region by shifting the potentials of the oxides in the base direction from the natural potential to the cathodic polarization potential. At this potential, the oxide is said to be unstable and will dissolve while the metal iron is stable and protected from corrosion. By this method, it is said to be possible to reduce the temperature and acid concentration of the wash bath while still achieving acceptable stripping times.

The method proposed in the Sumita et al. patent is believed to have many deficiencies, and is not believed readily applicable to chemical milling generally. On the one hand, the potential that is applied must be regulated and adjusted in accordance with the actual potentials encountered during the process. The nature of the oils that build up in a pickling tank, and the behavior of the materials therein, make it difficult, if not practically impossible, to monitor the various components and properly control the applied potential. Moreover, the electron injection method is not believed to produce any meaningful improvement in pickling process throughput.

With the chemical milling process of the invention, a skin layer of a monolithic metal product is removed without high concentration and/or high temperature acids, but in a short amount of time and without the need for an external power source, and particularly without imposition of an external positive voltage as proposed by Sumita et al. One example of the present invention is removal of mill scale as in my prior application. Other examples involve surface finishing by removing a skin layer from a monolithic metal product to provide the desired finish or thickness of the product, or to otherwise remove impurities from the surface of the monolithic metal product by stripping off the underlying skin of the product's surface. Additionally, the effect of the natural E° differential may be expanded by connecting an external voltage in the negative sense from the counter electrode to the metal product as opposed to the positive sense of Sumita et al. The negative potential need not be carefully regulated or controlled in relation to the bath or materials, and so is easier to apply and utilize than the positive potential of Sumita et al. and yet is believed to increase the rate of removal of the skin layer.

In accordance with yet a further feature of the present invention, the electrolyte bath may be acidic or basic in nature. In other words, the bath has a substantially non-neutral pH. The pH of an acid bath is advantageously less than 4, more advantageously less than 3, and most advantageously between −1 and +2. The pH of an alkaline bath is advantageously greater than 8 or 9, and more advantageously greater than 10.3.

In accordance with yet a further feature of the present invention, the electrolyte bath may be agitated, and this agitation may be ultrasonic. In the past, ultrasonic agitation has been achieved by inducing the agitation through the wall of the tank, and has been limited to metal tanks by virtue of the metal being better at conduction of the frequency than any other material. Ultrasonic agitation could not be used, however, for brick-lined tanks. Moreover, the metal tanks were subject to corrosion as a result of the metal being subjected to the high frequencies, which cause stress fractures in the material. In the present invention, a transducer encased in metal, such as HASTELLOY® C-276, is inserted into the electrolyte bath. The wave from the ultrasonic transducer hits the part to be chemically milled and bounces back thereby acting like a shock wave, first compressing, then expanding to cause the agitation. Because the agitation is induced through the electrolyte, this method of agitation may be used for any tank material.

By virtue of the foregoing, there is thus provided a chemical milling process that avoids the need for highly concentrated, high temperature acids, but which is easy to deploy and control, and may do so at a faster rate than prior chemical milling processes. These and other objects and advantages of the present invention shall become more apparent from the accompanying drawings and description thereof.

BRIEF DESCRIPTION OF THE DRAWINGS

The accompanying non-scale drawings, which are incorporated in and constitute a part of this specification, illustrate embodiments of the invention and, together with a general description of the invention given above, and the detailed description given below, serve to explain the principles of the invention.

DETAILED DESCRIPTION OF THE DRAWINGS

The present invention provides for the chemical milling of monolithic metal products to remove a skin layer from the surface thereof. Along with the chemical milling, any metallic or non-metallic impurities or deposits on the skin layer will also be removed. The present invention thus also provides, as discussed in my aforementioned patent application, for the removal of metal oxide scale from a metal member, such as steel, without the need to overcome the natural potentials of the metal and metal oxides, as in Sumita et al. To this end, and in accordance with the principles of the present invention, a monolithic metal member to be chemically milled is immersed in or otherwise associated with an electrolyte and dc coupled to a separate counter electrode exposed to the electrolyte and having an E° greater than the E° of the metal member without imposition of an external positive voltage from the electrode to the metal member. The standard electrode potential E° expressed in volts, is defined as the potential of an element immersed in a solution of its ions at unit activity. E° may be measured by Electrochemical Impedance Spectroscopy (EIS). An electromotive (driving) force (emf) results from the relative potential forces of the two dissimilar electrodes (the metal products and the counter electrode). The greater the magnitude of the differential between the E° values of the counter electrode and the metal member, the greater the emf produced, and thus a faster and more effective chemical milling of the skin layer may be obtained.

Figure 1:
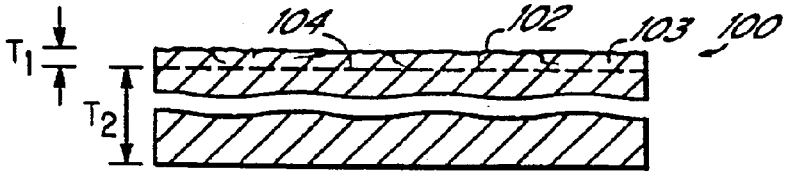
FIG. 1 is a cross-sectional view of a monolithic metal member to be chemically milled in accordance with the principles of the present invention.
Figure 2:
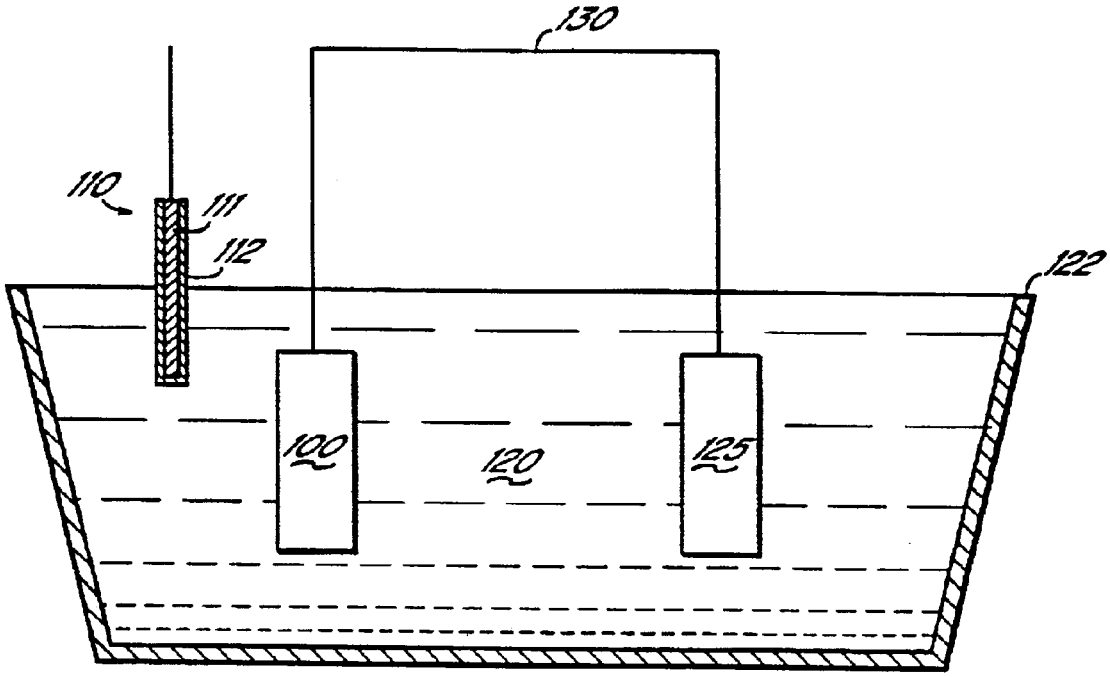
FIG. 2 is a diagrammatic view of the monolithic metal member of FIG. 1 being chemically milled in accordance with the principles of the present invention.
Figure 3:
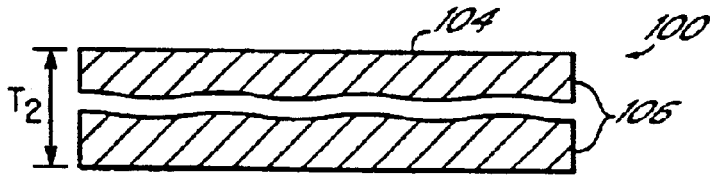
FIG. 3 is a cross-sectional view of the monolithic metal member of FIG. 1 after being chemically milled as shown in FIG. 2.

With reference to FIGS. 1 through 3, a general example of chemical milling in accordance with the principles of the present invention will be described. To this end, a monolithic metal member 100 has an original surface 102 from which a thin skin or layer 103 of thickness $T_1$ is to be removed to present a new surface 104. Member 100, at least to a depth $T_2$ which is substantially greater than thickness $T_1$, on the order of several times thicker to as much as several orders of magnitude thicker, and skin layer 103 are compositionally essentially the same as will be readily understood, although skin layer 103 may also have thereon oxides or other deposits (not shown) which will be removed from member 100 as skin 103 is chemically milled away. Skin 103 may also be rough or contain microcracks or other irregularities. Chemical milling of member 100 results in removing skin layer 103 to thereby define the thickness $T_2$ of member 100 from surface 104 and/or otherwise improve the surface of member 100 by removing the roughness, microcracks and/or other irregularities presented by skin 103.

In accordance with the principles of the present invention, monolithic metal member 100 is associated with an electrolyte bath 120 such as by being immersed in a container 122 of the bath material 120 as shown in FIG. 2. Container 122 may be made of any material appropriate for the particular application, such selection being within to ordinary skill of one in the art, and for example, may comprise plastic or metal, such as stainless steel. Bath 120 may be a dilute acid or base solution in water as will be discussed later, and may be at room temperature, although the bath may be warmed, if desired, to speed up the process. A counter electrode 125 is also associated with electrolyte 120 such as by being immersed in container 122 with member 100. Metal member 100 has a first natural E° and counter electrode 125 has an E° greater than the E° of the metal product 100. Counter electrode 125 and member 100 are dc coupled by any conventional electrical coupling, as exemplified by wire 130 in FIG. 2. The metal member surface 102 gives up electrons by virtue of the E° differential between the metal member 100 and the counter electrode 125. The process is continued until a desired amount of surface 102 (i.e., skin 103) is removed from metal product 100 to thereby leave remaining aspect 106 of member 100 and expose a new surface 104 that is smooth and contains no microcracks or surface impurities, as seen in FIG. 3. In most instances, the amount of skin layer 103 removed (thickness $T_1$) would be relatively small, on the order of 1–50 mils, especially as compared to the depth ($T_2$) of the compositionally similar remaining aspect 106 of member 100. Electrolyte 120 may be agitated to increase the rate of removal of skin layer 103. For example, an ultrasonic probe 110 may be inserted into the electrolyte 120 to produce shock waves that agitate the bath. By way of further example, the probe 110 may comprise an ultrasonic transducer 111 encased in a metal sheath 112, such as HASTELLOY® C-276. One such probe may be obtained from Etrema Products, Inc. of Ames, Iowa.

Monolithic metal member may be generally any metal or alloy, such as steel or zirconium, or other metal materials as will be apparent to those skilled in the art. By way of example, in the production of zirconium metal, plates of zirconium having dimensions of approximately 24" by 48" by 1" may be chemically milled in accordance with the principles of the present invention to remove up to 30 mils per side to remove surface impurities and flaws. To this end, reference is had to the following examples.

EXAMPLES

A number of experiments on zirconium plates were performed in a 100 mm×190 mm crystallization dish containing a slab of PVC plastic adapted to hold the samples and electrodes. The electrode material investigated was AFX-5Q, 0.12 inch thick milled graphite from POCO Graphite of Decatur, Tex. Five hundred milliliters of electrolyte was added in the crystal dish to cover about 1 inch in height of each sample. Comparative samples were not dc coupled to any electrode, while samples of the present invention were dc coupled to a counter electrode by means of a wire and alligator clips. Any other suitable means may be used in accordance with the principles of the present invention to provide an electrical path between the monolithic metal member and the counter electrode. The crystal dish was placed on a temperature controlled, magnetic spinner hot plate set at 166 RPM for agitation and temperature adjustment. The electrolyte comprised an acid or alkali and deionized water. The average sample included a relatively thin zirconium oxide layer and was about 1.5 inches wide, 3 inches long and between about 0.25 inch and 0.95 inch thick. Each sample was immersed two times, once at one end and once at the opposite end until complete or nearly complete stripping and milling was obtained.

The following discussion places emphasis on the mean results of the various tests. This is believed to take into account the various experimental errors introduced into the system.

The results are provided in terms of average weight loss, as an approximation of the efficiency of the system in chemically milling the skin layer, and removing any oxide which may be thereon. The surface area of each side of the samples varies from one side to the other and from one sample to the next. Furthermore, thickness of the thin oxide layer varies along the sample. Thus, statistical averages and general trends are examined to determine the efficiency of the present invention over processes that do not use a counter electrode. In some samples, complete or nearly complete milling was achieved and a smooth milled surface obtained, and in other samples pitting occurred. It is believed, however, that the results obtained demonstrate that the chemical milling system of the present invention is more efficient than the pickling and milling systems of the prior art.

Test Set 1

Two trial experiments were run as described above using a graphite electrode dc coupled to one side of the zirconium plate, the electrode and sample immersed in an electrolyte containing 30% by volume $HNO_3$ and 3% HF. No electrode was coupled to the other side of the sample during its immersion. The weight loss for each side of the sample was measured periodically until complete or nearly complete removal of the oxide and a skin layer of zirconium, and the total weight loss calculated. The total weight loss for milling with an electrode was divided by the total weight loss for milling without an electrode to obtain an approximation of the percent improvement of the milling process by use of an electrode.

For the samples dc coupled to the graphite electrode, the average total weight loss was 1.60 grams for the first trial and 1.53 grams for the second trial, while the average total weight loss for the same samples milled without an electrode was 0.99 grams for the first trial and 1.14 grams for the second trial. Thus, the electrode milling system of the present invention displayed, on average, a 61% improvement in milling efficiency in the first trial and a 34% improvement in the second trial, for a total mean improvement of 47.5%.

The weight loss of the samples was also measured after 20 minute of immersion, and for the samples dc coupled to the graphite electrode, the average total weight loss was 0.52 grams per 20 minutes of immersion, while the average total weight loss for the same samples milled without an electrode was 0.355 grams per 20 minutes of immersion. Thus, the electrode milling system of the present invention displayed, on average, a 46.4% improvement in milling efficiency after 20 minutes of milling.

Test Set 2

Trial experiments were run as in Test Set 1, but using 18% $HNO_3$ and 3% HF. For the samples dc coupled to the graphite electrode, the average total weight loss was 0.644 grams per 20 minutes of immersion, while the average total weight loss for the same samples milled without an electrode was 0.546 grams per 20 minutes of immersion. Thus, the electrode milling system of the present invention displayed, on average, a 17.9% improvement in milling efficiency after 20 minutes of milling.

Test Set 3

Trial experiments were run as in Test Sets 1 and 2, but using 18% $HNO_3$, 3% HF and 2.4% $H_2O_2$. For the samples dc coupled to the graphite electrode, the average total weight loss was 0.900 grams per 20 minutes of immersion, while the average total weight loss for the same samples milled without an electrode was 0.75 grams per 20 minutes of immersion. Thus, the electrode milling system of the present invention displayed, on average, a 20% improvement in milling efficiency after 20 minutes of milling.

Figure 4:
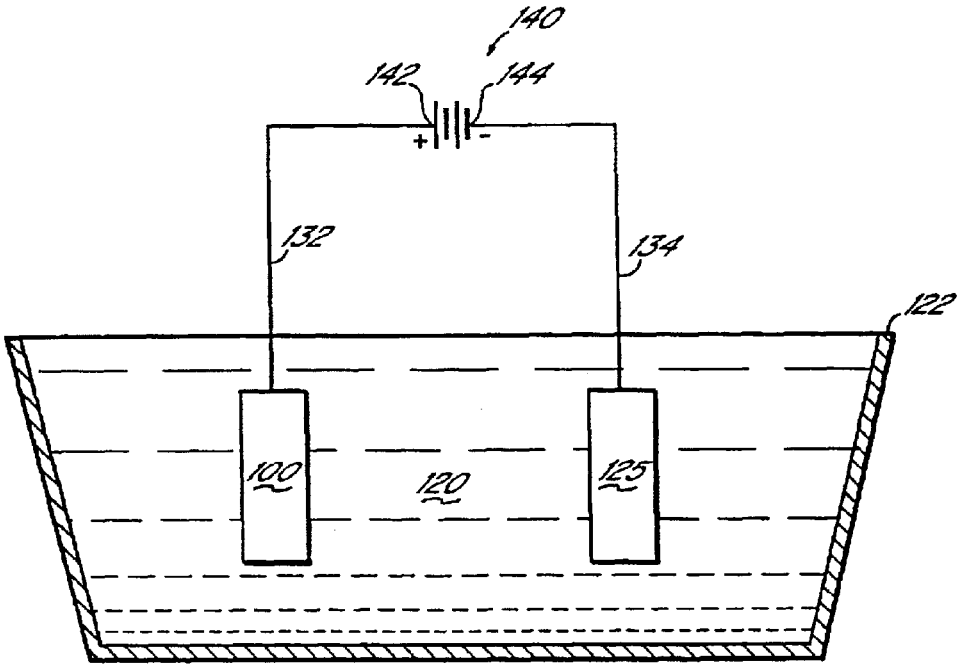
FIG. 4 is a schematic view of an alternative embodiment for chemical milling of the monolithic metal member of FIG. 1 in accordance with the principles of the present invention.

In the above descriptions, the member 100 and counter-electrode 125 are dc coupled without imposition of any external power supply, especially one that would impart a positive voltage from counter electrode 125 to member 100, yet chemical milling is achieved. If desired, however, an external power source 140 may be placed in the circuit to add an additional electromotive force over the natural one as shown in FIG. 4. This additional voltage, which may, for example, be in the range of 1–6 volts, with the positive cathode 142 dc coupled via wire portion 132, or other conductors, to the monolithic metal member 100 and the negative anode 144 dc coupled via wire portion 134, or other conductors, to the counter electrode 125, is thus added in the negative sense. Member 100 is thus dc coupled to counter electrode 125 through source 140 while expanding the effect of the E° differential so as to speed up the reaction according to Ohm's Law (E=IR). Whereas Sumita et al., discussed above, imposed a positive voltage from the counter electrode to the steel product to, in effect, overcome the natural potentials of the system, the present invention adds negative voltage from the counter electrode to the monolithic metal member to, in effect, enhance the natural potentials of the system. Thus, while an external power source is not essential to achieve chemical milling of the monolithic metal member, it may serve to speed up the process if applied in the negative sense to thus increase the efficiency of the process.

The chemical milling process may also be used to also remove undesired scale or other build-ups from the surface of a monolithic metal member, an example of such build-up being metal oxide scale. As discussed in my prior application, the removal of metal oxide scale is believed to be an electrochemical event. In fact, all aqueous corrosion can be considered electrochemical. In other words, one can usually find two metals, an electrolyte and an electrical path. Chemically, a description of what is believed to occur may be useful. Even if one single monolithic steel bar is immersed in the acid, an electrochemical cell is set up. One side of the cell will be comprised of the steel matrix. Because steel is mainly a very low carbon iron (less than 1 wt. % carbon) along with a few impurities, it is primarily an iron matrix. Directly attached to it is FeO, an unstable oxide of iron. The FeO is considered more noble (higher E°) than the iron. The acid is considered the electrolyte. Although FeO is not a particularly good conductor of electrons, any connection between the iron matrix and the FeO matrix will function as the electrical connector.

A solitary atom of iron of zero valence, defined as Fe°, is not thought to exist in aqueous solution. For metals to be dissolved in solution, they must first be ionized to a valence state, $Fe^{+2}$ or $Fe^{+3}$, then surrounded by ligands, normally supplied by the acid electrolyte or by water, then hydrolyzed or surrounded by water molecules. The water molecules with their partial polar nature (the oxygen side is slightly negative and the hydrogen side is slightly positive) help to completely neutralize the charge in solution. The result is large, loosely held molecules with a single iron atom, ionized, in the center position.

Ionization takes place when either two or three electrons are given up by the iron atom as it goes into solution. In all electrochemical cells, there is an electrical current that follows the Ohm's Law, E=IR. The two sides become polarized as one becomes rich in electrons, thereby attracting the iron ion in solution to the other material, in this case the FeO. Once there, another electron exchange takes place, and reaction by-products are produced.

This explanation becomes far more complicated due to the other two iron oxide phases, $Fe_2O_3$ or $Fe_3O_4$. In this case the $Fe_3O_4$ is more noble than the $Fe_2O_3$ and likewise $Fe_2O_3$ is more noble than FeO. Therefore, small, simultaneous electrochemical cells are also set up for the $Fe_2O_3$-$Fe_3O_4$ couple, the FeO-$Fe_2O_3$ couple, and the Fe-FeO couple.

The pickling of steel is an electrochemical event where the piece of steel itself polarizes to form the function of both anode and cathode. To some, this may seem a theoretical impossibility. Normally, a monolithic piece of steel is presumed conductive and therefore at the same electrical potential everywhere. Due to the internal resistance of the steel, and the possibility of formation of Nernst Diffusion layers of different concentrations at various positions on the steel, plus several different layers of oxides, it is possible to sustain a small voltage difference.

As pickling is an electrochemical event, it is also possible to alter the pickling bath configuration. In the improvement of the present invention, a separate counter electrode of a material different, but more noble, than steel is added to the pickling tank. By direct dc coupling of the steel being immersed to the counter electrode without imposition of an external positive voltage from the electrode to the steel, a larger electromotive force is induced into the steel product than if no such connection is made. The result is that the pickling operation can be made to operate faster while reducing concentration and temperature of the bath, thus providing desired chemical milling which not only removes a thin or skin layer from the steel product, but the metal oxide scale thereon along with the skin layer.

Figure 7:
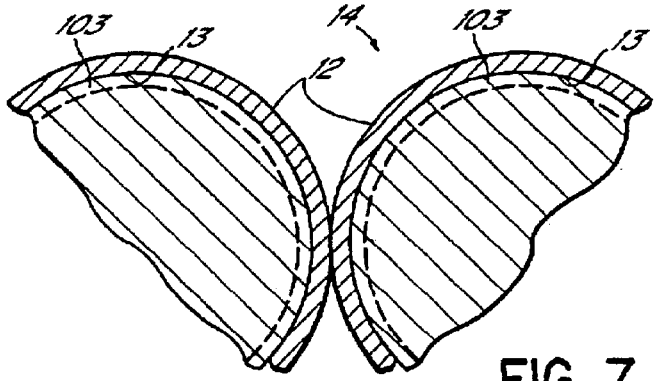
FIG. 7 is an enlarged view in cross-section of Area 7 of steel products in the system of FIG. 6.
Figure 5:
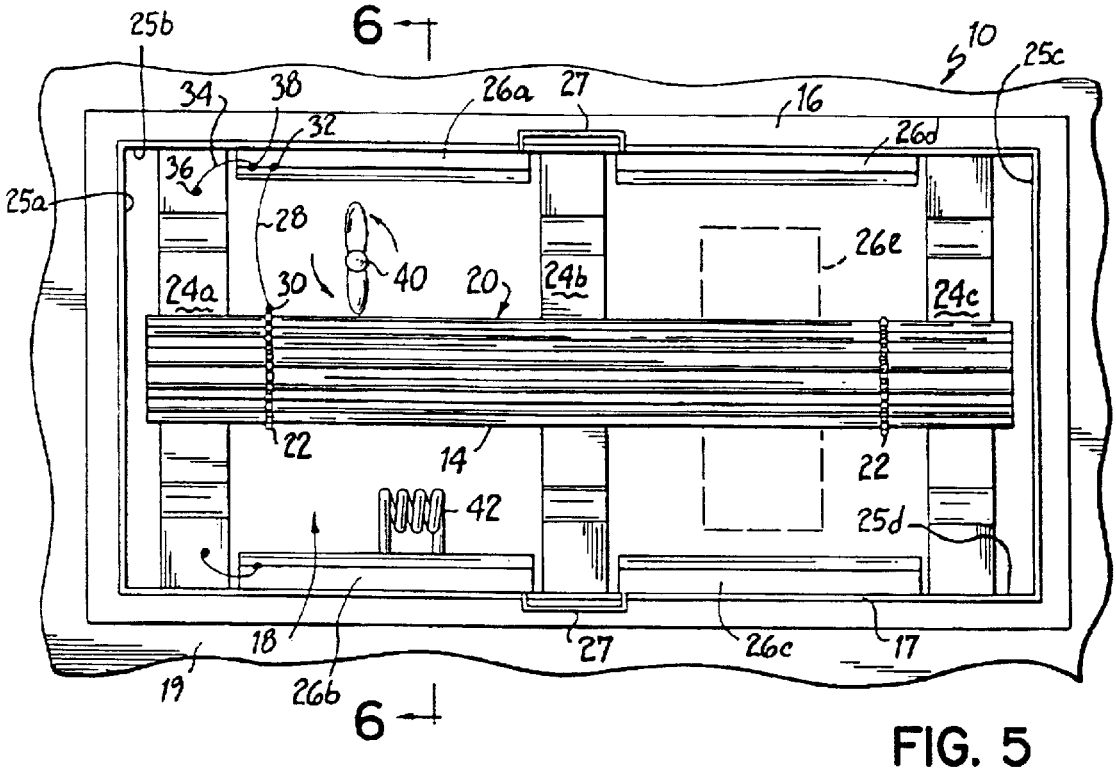
FIG. 5 is a top plan view of a batch-type pickling system for stripping metal oxide scale from a bundle of steel products in accordance with the principles of the present invention.
Figure 6:
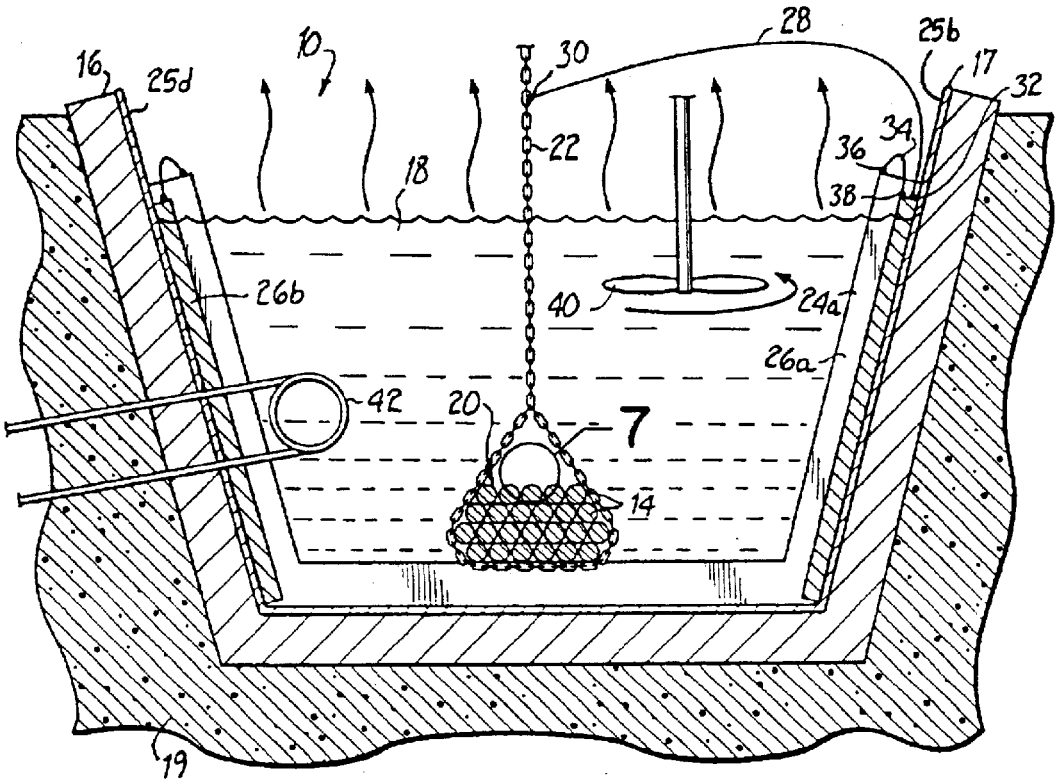
FIG. 6 is a cross-sectional view of the system of FIG. 5 taken along line 6—6.

With reference to FIGS. 5 and 6, there is shown in plan view and cross-section, respectively, a batch-type pickling system 10 for stripping steel products 14, such as steel bars. As seen in the enlarged view of FIG. 7, the steel product 14 has an iron oxide scale layer 12 over the major surface of steel 13, which scale layer 12 is to be removed from surface 13. The mill scale coated steel products 14 are immersed in a tank 16 having an acid resistant liner 17 and filled with an electrolyte 18, such as a dilute acid or base solution in water. Tank 16 may be supplied in the ground, as at 19. A plurality of steel products 14 may be grouped together in a bundle or lift 20 and immersed in the tank 16 by one or more chain slings 22 or other suspension device capable of lowering and raising the bundle 20. The chain sling 22 may be made of high strength material such as HASTELLOY® C-276, a nickel-chromium-molybdenum alloy, or stainless steel 316. The tank may also be provided with one or more bolsters 24 in the bottom of the tank 16 to provide structural support for the extremely heavy steel products (about 5 tons in a bundle) laid to rest upon the bolsters 24. This may prevent structural damage to the bottom of the tank 16. The bolsters 24 are made of a material of sufficient strength to support the large tonnage, such as HASTELLOY® C-276 or other corrosion-resistant materials. As shown in the embodiment of FIGS. 1 and 2, three U-shaped bolsters 24*a*, 24*b*, 24*c* are placed in the tank to support the ends and the middle of the immersed bundle 20 of steel bars.

One or more counter electrodes 26 having an E° greater than the E° of the steel product 14 is immersed in the electrolyte 18. The counter electrode 26 advantageously has an immersed surface area equal to or exceeding the total surface area of all steel products 14 immersed in the electrolyte 18 to insure that the electrochemical reaction proceeds to completion, but this relationship is not considered essential in the system of the present invention. Given the immense size of the batch-type tanks 16 used for pickling steel products, generally on the order of 24 feet long, by 10 feet wide, by 4 feet deep, the counter electrodes 26 advantageously comprise graphite sheets in the form of slabs or plates lining one or more of the inner walls 25 of the tank 16. In FIG. 5, two counter electrodes 26*a, d* line inner wall 25*b*, and two counter electrodes 26*b, c* line inner wall 25*d*. If more than one counter electrode is needed to provide the desired surface area, the counter electrodes 26*a*, 26*b*, 26*c*, 26*d* need to be conductively connected to each other, but need not form a sealed lining within the tank. Any type of connection 27 (by way of example, clips, solder, screws, rivets, welds, rods, etc.) known to one skilled in the art may be used to conductively dc couple the counter electrodes. Further, additional counter electrodes 26*e* (shown in dotted line) may be provided in the bottom of the tank, such as between the optional bolsters 24*b, c* provided they, too, are conductively coupled to the other counter electrodes 26*a–d*.

The counter electrode 26 is electrically dc coupled to steel products 14 such as by a wire 28 connected as at 30 and 32 to chain sling 22 and counter electrode 26, respectively, and/or such as by wire 34 connected as at 36 and 38 to bolster 24 and counter electrode 26, respectively. The connection may be by any conductive connection, such as clips, solder, screws, rivets, welds, rods, etc. The chain sling 22 or the bolster 24, if part of the dc circuit, are made from a conductive material more noble (i.e., higher E°) than the steel products 14. Wire 28 and/or wire 34 provides a dc current path between steel products 14 and counter electrode 26. It should be noted that no external power supply is used to impart a positive voltage from the electrode 26 to the steel product 14; and yet, full stripping may be achieved. As discussed previously, it is believed that when the dc coupled items are placed into the tank 16, an electrochemical cell is created having a large electromotive force such that an electrochemical corrosion reaction results. That reaction is believed to strip a thick layer of skin 103 at surface 13 of the steel products 14, along with the scale layer 12 thereon. It is further believed that the scale 12 dissolves into electrolyte 18. The amperage of the system should be about 0.23 Amps for every 3 to 4 square inches of total immersed steel. If desired, however, an external power source may be placed in the circuit to add an additional electromotive force over the natural one as described above in connection with FIG. 4. Whereas Sumita et al., discussed above, imposed a positive voltage from the counter electrode to the steel product to, in effect, overcome the natural potentials of the system, the present invention adds negative voltage from the counter electrode to the steel product to, in effect, enhance the natural potentials of the system. Thus, while an external power source is not essential to achieve stripping of the metal oxide scale from the steel, it may serve to speed up the process if applied in the negative sense to thus increase the efficiency of the pickling process.

A device for agitating or stirring the electrolyte is added to the system to speed up the pickling rate. This device may comprise a stirring mechanism or agitator 40 in the electrolyte bath as shown in FIG. 5, it may be a pump (not shown) that continuously adds and extracts electrolyte from the tank to thereby agitate the bath, or it may be the ultrasonic probe 110 as described above in the embodiment of FIG. 2.

The electrolyte 18 may effectively strip skin layer 103, and thus scale layer 12, from the steel products 14 when maintained at room temperature, and advantageously, electrolyte 18 is a dilute solution of acid or base in water, as will be discussed later. If it is desired that the electrolyte 18 be above room temperature to increase the pickling rate, a heating coil 42 may be provided in the tank 16. Regardless of the type of electrolyte 18, the acid or base concentration, or the temperature of the bath, the use of a counter electrode 26 in accordance with the principles of the present invention lessens the time necessary for stripping a scale layer 12 from a steel product than occurs in conventional pickling processes.

Figure 10:
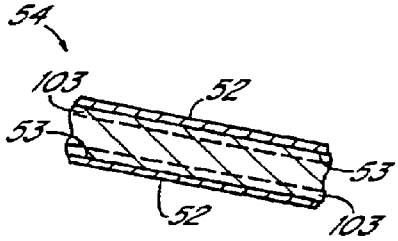
FIG. 10 is an enlarged view in cross-section of Area 10 of the steel strip in the system of FIG. 8.
Figure 8:
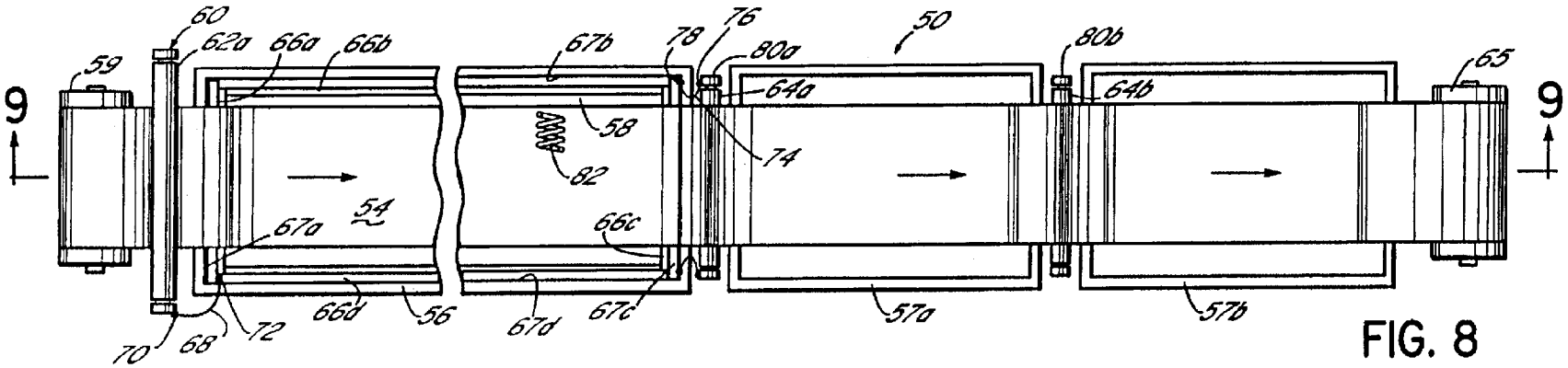
FIG. 8 is a top plan view of a continuous pickling line for stripping metal oxide scale from steel strip in accordance with the principles of the present invention.
Figure 9:
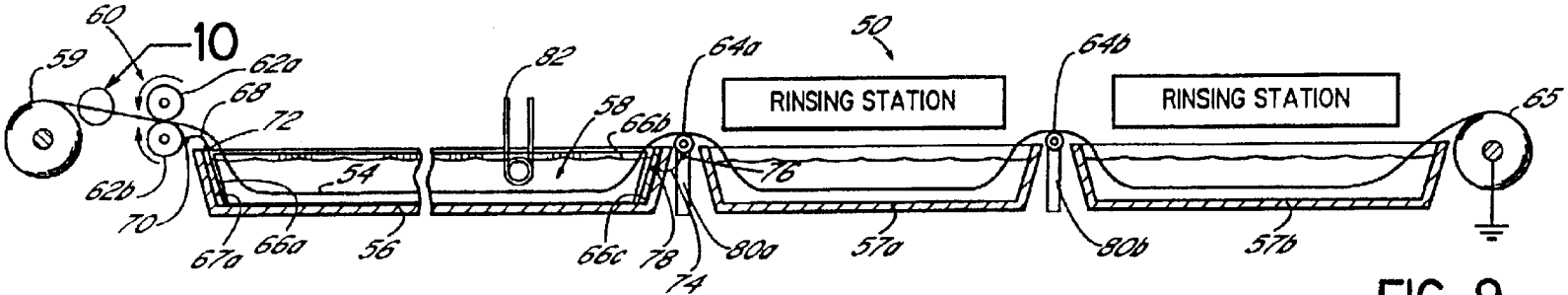
FIG. 9 is a cross-sectional view of the system of FIG. 8 taken along line 9—9.

With reference to FIGS. 8 and 9, there is shown a top plan view and crosssectional view, respectively, a continuous-type pickling system 50 for stripping metal oxide scale layer 52 from a steel sheet 54. As seen in the enlarged view of FIG. 10, the steel sheet 54 has an iron oxide scale layer 52 over the major surfaces 53 of steel sheet 54, which scale is to be removed from steel surfaces 53. The scale coated steel sheet 54 is immersed in a tank 56 filled with an electrolyte 58, such as a dilute acid or base solution in water, followed by immersion in one or more rinsing tanks 57*a*, 57*b* filled with water for rinsing the acid from steel sheet 54. This system 50 is a continuous pickling line. similar to those typically used in the industry for removing scale 52 from the steel subsequent to the continuous hot rolling operation in preparation for the cold reduction of the sheet to final thickness. After hot rolling, the steel sheet is typically coiled and prior to pickling, the sheet is uncoiled, such as by uncoiler 59, and passed through a scale breaker 60, which consists of a pair of rollers 62*a*, 62*b*. The rollers flex the steel around the rolls, thus effectively "breaking" the surface scale into numerous fine cracks, which increases the available suboxide area for acid attack in the pickling process. The steel sheet 54 is then fed from the scale breaker 60 into a first acid tank 56 at a continuous or semi-continuous rate for a time sufficient to remove the skin layer 103 and scale layer 52 thereon from the steel sheet 54. If desired, the electrolyte 58 may be heated to above room temperature to increase the pickling rate, such as by heating coil 82. Furthermore, an agitator (not shown) may be added to the tank 56 to agitate or stir the electrolyte 58 to increase the pickling rate, and acid spraying devices (not shown) may also be used, as known in the art, to spray the acid onto the sheet steel 54. The continuous feeding of the steel sheet may involve passage through a series of acid tanks (not shown) optionally situated with additional scale breakers (not shown) between tanks. The steel sheet 54 is then fed, such as by looping supports 80*a*, 80*b* with rollers 64*a*, 64*b* positioned thereon, through one or more rinsing tanks 57*a*, 57*b* filled with water to remove the acid from the surface of steel sheet 54, followed by coiling, such as by coiler 65.

The acid tanks 56, and optionally one or more of the rinsing tanks 57*a*, 57*b*, further include one or more counter electrodes 66 having an E° greater than the E° of the steel sheet 54. The counter electrodes 66 may advantageously have an immersed surface area equal to or greater than the immersed surface area of the steel sheet 54, although this relationship is not essential in the system of the present invention. Given that the steel sheet 54 is continuously moving through each tank, the surface area referred to is that area in the tank at any given point in time, which is a relatively constant value. In FIG. 8, four counter electrodes 66*a*, 66*b*, 66*c*, 66*d* line inner walls 67*a*, 67*b*, 67*c*, 67*d*, respectively of tank 56. The counter electrodes 66*a*, 66*b*, 66*c*, 66*d* must be dc coupled to each other. Additional counter electrodes (not shown) may be placed in the bottom of the tank, provided they, too, are dc coupled to the other counter electrodes 66*a–d*. The counter electrode 66 is electrically dc coupled to steel sheet 54 such as by a wire 68 connected at 70 and 72 to scale breaker 60 and counter electrode 66*a*, respectively, and/or by wire 74 connected at 76 and 78 to a conductive component, such as looping support 80, which is in contact with the steel sheet 54, through roller 64, and counter electrode 66*c*, respectively. To this end, scale breaker 60 and it's rollers 62*a*, 62*b* and/or support 80 and it's roller 64 are dc conductive. Wire 68 and/or wire 74 and the conductive scale breaker 60 and/or support 80 provide a dc current path between steel sheet 54 and counter electrode 66. The same electrochemical corrosion reaction that occurred between the steel products 14 and counter electrode 26 as described in reference to FIGS. 5 and 6 is also believed to occur between steel sheet 54 and counter electrode 66, and may therefore use the same weak acid or base electrolyte as used in the system of FIGS. 5 and 6.

With reference to both the embodiments of FIGS. 5 and 6 and FIGS. 8 and 9, the counter electrodes 26 or 66 may be formed in a slab-like or plate-like shape that partially line one or more inner walls of the tank 16 or 56. More than one counter electrode may be used if needed to achieve the desired surface area. The counter electrode 26 or 66 may be formed of such materials as graphite, nickel-base alloys, cobalt-base alloys, HASTELLOY® C-276, which is a nickel-chromium-molybdenum alloy, platinum, palladium, niobium-expanded mesh coated with platinum, such as DCX125 (125 $\mu$-inch platinum over double-clad expanded niobium) (available commercially from Vincent Metals, Canonchet, R.I.), platinized titanium (titanium (expanded mesh or non-mesh) plated with platinum, then heat treated to diffuse/disperse the platinum onto and into the titanium), ruthenium, osmium or rhodium. These materials all have an E° greater than the E° of steel. Graphite is relatively inexpensive and thus is preferred for use in the steel industry simply because it may be too cost prohibitive to line the immersion tanks with expensive materials like platinum. A portion of the counter electrode 26 or 66 could extend above the electrolyte level so that a dc coupling may be made to the steel without the dc coupling connection corroding during the pickling process.

As stated previously, regardless of the type of electrolyte, the acid or base concentration, or the temperature of the bath, an electrochemical cell is thought to be created, enhanced by the dc coupling to the counter electrode without imposition of an external positive voltage from the electrode to the steel, whereby the skin layer 103 is effectively removed from the monolithic metal member 100. When member 100 is steel bars 14 or sheet 54 with a metal anode layer 12 or 52 thereon, removal of the skin 103 also carries with it the mill scale 12 or 52 thereon. Electrolyte 18, 58 or 120 maybe acidic or basic in nature. The pH of the electrolyte 18, 58 or 120 is substantially non-neutral. The pH of the acid bath is advantageously less than 4, more advantageously less than 3, and most advantageously between −1 and +2. The pH of the alkaline bath is advantageously greater than 8 or 9, and more advantageously greater than 10.3.

In one feature of the invention, electrolyte 18, 58 or 120 is a dilute solution of acid or base in water. Advantageously, the acid or alkali content is less than 20% by volume, but may be up to 35%, and even up to 50%, if desired. By way of example, and not intended to limit the scope of the present invention, an electrolyte 18, 58 or 120 may contain one or more of the following industrial acids or salts: hydrochloric acid, sulfuric acid, phosphoric acid, nitric acid, hydrochloric acid, and ferric chloride. For example, a weak acid comprising 12.5% by volume nitric acid and 5% by volume phosphoric acid may be used. The use of phosphoric acid is believed to enhance the evenness of the pickled surface, thereby reducing surface roughness. This may contribute to a yield improvement in the final steel product because less material is removed in the corrosion operation. Any Lewis acid is suitable for use in the present invention. Examples of Lewis acids include ferric chloride, chrome chloride, and aluminum chloride. Alternatively, electrolyte 18, 58 or 120 may contain one or more alkalies, such as sodium hydroxide or ammonium phosphate.

There are thousands of ionic salt solutions, known to persons skilled in the art, that are suitable for use in the electrolyte of the present invention and are considered to be within the scope of the appended claims. It should be understood that newly developed and previously known electrolytes may be used in accordance with the invention. For example, sulfuric acid is typically selected for batch pickling of steel products due to its low cost, while hydrochloric acid is typically selected for continuous pickling of sheet steel because it is faster. These acids may be used in lower concentrations and at lower temperatures, however, than previously used, thus making the chemical milling and pickling process more environmentally friendly.

While not necessary, ammonium bifluoride, hydrazine, or a salt, such as sodium nitrate or sodium iodide, could be added to the electrolyte 18, 58 or 120 to aid the necessary reaction for chemical milling the skin 103 and/or stripping the scale layer 12 or 52. Peroxides, methanol, or isopropanol may also be added in small amounts. Any substance may be added to the electrolyte bath in accordance with the principles of the present invention to speed up the reaction to cause more efficient milling or stripping, or to achieve any other beneficial result.

In a further feature of the invention, the electrolyte bath may be operated at room temperature. Room temperature varies according to the environment, but it is typically between 55° F. and 105° F. (13° C.–41° C.). Advantageously, the bath is maintained at 90° F. (32° C.). Higher temperatures, preferably less than about 160° F. (72° C.), may also be used for speeding up the stripping process. This may be achieved by adding a heating coil, such as coil 42 of FIGS. 5 and 6 to heat the electrolyte bath. The higher the temperature, the faster the reaction proceeds, but this also creates an increase in the amount of fumes produced from the acid bath. Thus, a more environmentally friendly pickling process is achieved with lower temperatures, but with slower reaction rates. As stated previously with reference to FIGS. 2 and 5, a device for agitating the electrolyte bath may also be added to speed up the process. Additionally, it is preferred that the surface of the electrolyte bath be skimmed continuously or periodically to remove dirt, oil, dissolved oxide and the like so as to maintain a clean bath, if necessary.

Figure 11:
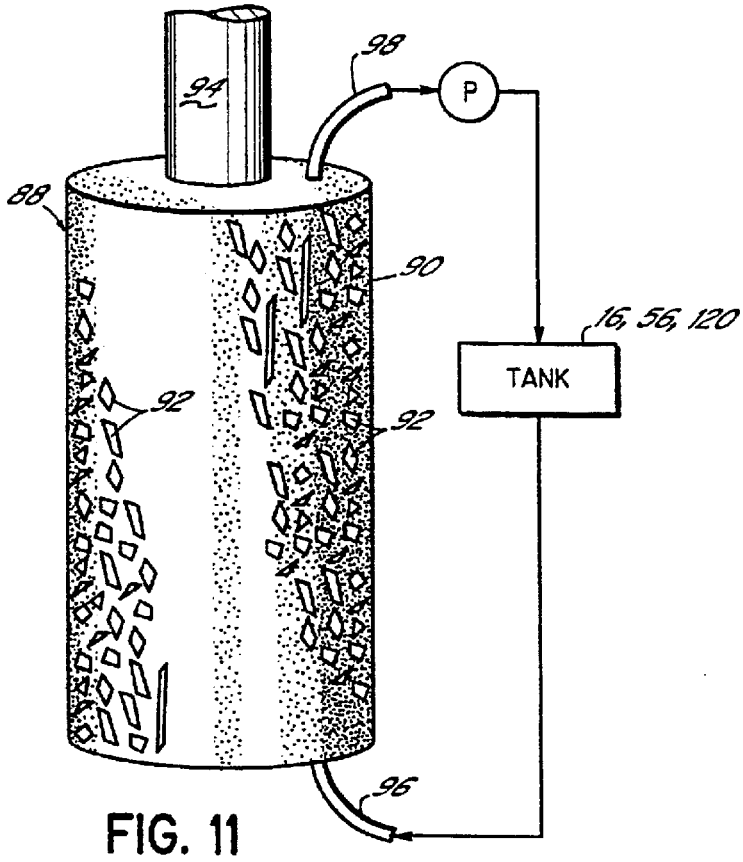
FIG. 11 is a side elevational view of an alternative embodiment of a counter electrode for use in the present invention.

With reference to FIG. 11, a counter electrode 88 has an increased surface area of exposure. Electrode 88 consists of a plastic canister 90 (approximately 55 gallons) containing broken graphite pieces 92 or granular graphite material (approximately 300 lbs. in a 55 gallon canister). This counter electrode 88 need not be contained within the container 122, such as tank 16 or 56, and may be used in conjunction with or in lieu of counter electrodes 26, 66, or 125 discussed above. A graphite buss bar or cable 94 is connected at one end to the plastic canister 90 and at the other end to the monolithic metal member 100 (such as steel product 14 or sheet 54) or a conductive component in direct or indirect dc contact therewith (such as wire 130, chain sling 22, bolster 24, scale breaker 60 or looping support 80). The acid in the electrolyte may be sucked from container 122 or tank 16 or 56, through tube 96 into the plastic canister 90 containing the graphite 92, and pumped back into the container 122 or tank 16 or 56 through tube 98 by pump P to provide agitation to the electrolyte and to thus, effectively, immerse the graphite in the electrolyte by associating the electrolyte with the graphite. The same electrochemical reaction occurs to effectively chemical mill the member 100 and/or strip metal oxide scale layer as occurred in the embodiments of FIGS. 1 through 3, 5 and 6, and 8 and 9. Thus, it may not be necessary to physically immerse a counter electrode in the electrolyte bath provided the electrolyte is brought into contact with a counter electrode material to, in effect, immerse the counter electrode. Similarly, although the above description details a system in which the monolithic metal member is immersed in the electrolyte, the present invention contemplates the reverse system in which the electrolyte is brought into contact with the monolithic metal member. Examples of other ways to associate the electrolyte with the metal member include spraying or flooding the metal member surface with the electrolyte.

Figure 12:
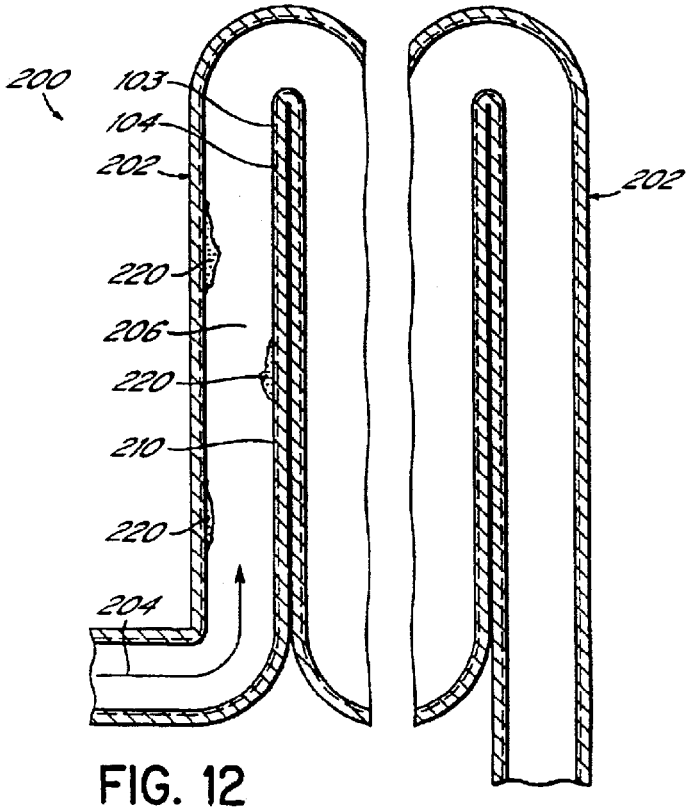
FIG. 12 is a representative elevational view of a section of boiler tube-wall pipe having surface deposits on an interior surface of a tube thereof.

Just as the chemical milling of the present invention has the advantage that formations on the surface, such as mill scale, may be removed along with the skin layer, it is also an advantage of the present invention that chemical milling may be applied to remove impurities build-ups such as often occurs in tubes or pipes carrying fluids, such as hot water. With reference to FIG. 12, there is shown an exemplary section of generating station boiler tube-wall 200 comprised of a plurality of fluidically interconnected monolithic steel tubes or pipes 202. Fluid 204, such as water, is generally intended to be pumped through the hollow interior 206 of tubes 202 and along interior surfaces 210 to be heated by burning coal (not shown) in the vicinity of the tube-wall 200. The fluid 204 becomes heated and is then utilized to generate electricity by turning turbines (not shown), for example. Over time, the interior surface 210 of one or more tubes 202 begins to cake over with deposits 220 such as non-metallic compounds of carbonates, sulfates, or other chemicals. These scale or mineral deposits 220 tend to restrict hollow interior 206 and can even completely close off passage of fluid 204 through one or more of the tubes 202. In that case, the affected tubes 202 would normally have to be replaced.

Figure 13:
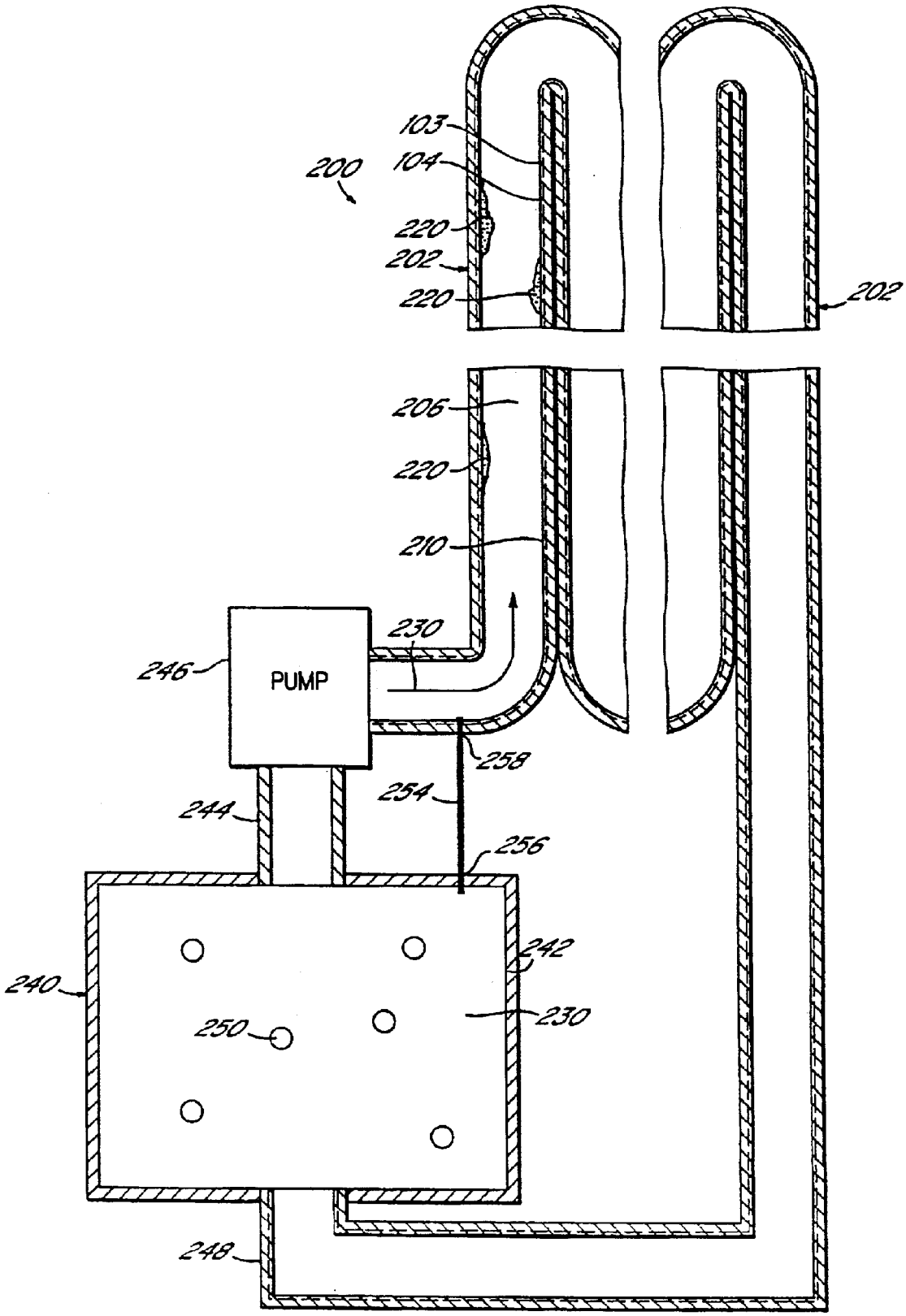
FIG. 13 is a diagrammatic view of the boiler tube-wall of FIG. 12 being chemically milled in accordance with the principles of the present invention.

In accordance with a feature of the present invention, however, the need to replace such affected tubes 202 can be reduced or eliminated. To this end, and with reference to FIG. 13, electrolyte 230 is associated with tubes 202, such as by being pumped therethrough in place of, or along with, fluid 204, while at the same time dc coupling one or more of the tubes 202 to a counter electrode 240 having a higher E° than that of tubes 202, and without imposition of an external voltage in the positive sense. To accomplish the foregoing, a tank-like counter electrode 240, similar to counter electrode 88 of FIG. 11, may be employed. Counter electrode 240 includes a tank 242 containing electrolyte 230 therein, and having an outlet 244 coupled via pump 246 to be in series with fluid flow at least into the tube-wall tubes 202, and may have an inlet 248 to receive the fluid flow back out from tubes 202 and into tank 242. Contained within tank 242 is one or more pieces of counter-electrode material 250, having an E° higher than that of tubes 202. A conductive cable 254 is connected electrically at one end 256 into tank 242 so as to be dc coupled to counter electrode material 250, and at the other end 258 to one or more tubes 202 so as to be dc coupled to tube-wall 200 and, advantageously, affected tubes 202 thereof. If desired, a plurality of conductive cables 254 could be used for dc coupling counter electrode 240 to tubes 202 at spaced intervals along boiler tube-wall 200.

As pump 246 operates to flow electrolyte 230 through tank 242 and through tubes 202, a skin layer 103 of tubes 202 will be chemically milled from interior surfaces 210 thereof and also carry therefrom, and possibly dissolve into electrolyte 230, the deposits 220 otherwise adhered to interior surfaces 210 of tubes 202. The skin layer 103 and associated deposits 220 can be carried away out of tubes 202 along with the electrolyte 230 to thereby clear tubes 202 without necessarily replacing same. The dc coupling is without imposition of an external voltage in the positive sense, although, as described above in connection with FIG. 4, an external voltage may be imposed in the negative sense for further advantage. Although shown for a plurality of tubes, the above may be equally applicable to single tubes or pipes which comprise monolithic metal members with deposit build-up interiorly therein.

While the above detailed description focused in large part on the principles of the present invention as they apply to zirconium plates, steel and iron oxide scale, and boiler tube scale, it is to be understood that the principles of the present invention extend to other monolithic metals and alloys, and to their respective scales and surface deposits, whether metallic or non-metallic in nature. It is to be further understood that the principles of the present invention extend to monolithic metals and alloys having surface defects or impurities to be removed to expose a new surface on the monolithic body. Thus, the system and process of the present invention may be used to remove a metal surface itself or any material from a metal surface, including build-ups of metal oxides or non-metallic deposits.

In use, a monolithic metal (or alloy) product is immersed into an electrolyte, or otherwise associated with an electrolyte, and the electrolyte is immersing or otherwise associated with a counter electrode of E° higher than the E° of the metal (or alloy), and the metal (or alloy) product is dc coupled to the counter electrode without imposition of an external positive voltage from the electrode to the metal (or alloy), whereby metal oxide scale, non-metallic surface deposits, or surface defect portions present on the metal (or alloy) surface is dissolved into the electrolyte bath. By virtue of the foregoing, a process and system are provided for the efficient and complete removal of metal oxide scales and materials comprising surface deposits and non-oxide scales from virtually any metal product by an electrochemical reaction as well as removal of a portion of the surface itself, when desired.

While the present invention has been illustrated by the description of embodiments thereof, and while the embodiments have been described in considerable detail, they are not intended to restrict or in any way limit the scope of the appended claims to such detail. Additional advantages and modifications will readily appear to those skilled in the art. For example, while room temperature stripping baths are desirable for environmental and safety reasons, medium to high temperature acid baths may be used for stripping or milling metal products to obtain complete removal in a short length of time. Also, the electrolyte may be an alkali bath instead of an acid bath. Furthermore, various monolithic metal members may be chemically milled in accordance with the present invention, some examples of which, without limitation, are stainless steel, aluminum, zirconium, zinc, copper, and alloys of the foregoing. Moreover, the monolithic metal member may be the primary surface on a substrate of like or dissimilar material, typically metal, where there is a need to remove a thin or skin layer from the otherwise relatively thick primary surface on the substrate. The invention in its broader aspects is, therefore, not limited to the specific details, representative apparatus and method and illustrative examples shown and described. Accordingly, departures may be made from such details without departing from the scope or spirit of applicant's general inventive concept.

What is claimed is:

1. An external counter electrode comprising:

a container having a fluid inlet and a fluid outlet, the container being adapted to pass a substantially non-neutral pH electrolyte therethrough between the fluid inlet and the fluid outlet; and counter electrode material housed within the container and in fluid communication with the fluid inlet and the fluid outlet such that said electrolyte may contact the counter electrode material as it passes through the container, the counter electrode material being selected to have an E° greater than a natural E° of a metal member which is to be in fluid communication with the electrolyte; and a dc connection to the counter electrode material and adapted to be electrically coupled to said metal member.

2. The external counter electrode of claim 1, the counter electrode material being selected from the group consisting of: graphite, nickel-base alloys, cobalt-base alloys, nickel-chromium-molybdenum alloys, platinum, platinized titanium, niobium expanded mesh coated with platinum, ruthenium, osmium, rhodium, and palladium.

3. The external counter electrode of claim 1, the counter electrode material including graphite.

4. The external counter electrode of claim 1, the counter electrode material including platinum.

5. The external counter electrode of claim 1, the counter electrode material including platinized titanium.

6. The external counter electrode of claim 1, the counter electrode material including niobium expanded mesh coated with platinum.

7. The external counter electrode of claim 1, the container being plastic.

8. The external counter electrode of claim 1 further comprising a pump operatively associated with the container.

9. A system for cleaning a passageway of a metal member comprising:

a metal member having a passageway and a deposit on a surface of the passageway, the metal member having a first natural E°;

a separate container having a fluid inlet and a fluid outlet;

counter electrode material in the container, the counter electrode material having a second natural E° greater than the first natural E°;

a dc electrical connection between the counter electrode material and the metal member;

an electrolyte having a substantially non-neutral pH; and a fluidic coupling from the fluid outlet to the passageway, wherein the electrolyte is adapted to flow into the container through the fluid inlet, contact the counter electrode material, flow out the fluid outlet, and into the passageway to thereby clean the deposit from the surface of the passageway.

10. The system of claim 9, the counter electrode material being selected from the group consisting of: graphite, nickel-base alloys, cobalt-base alloys, nickel-chromium-molybdenum alloys, platinum, platinized titanium, niobium expanded mesh coated with platinum, ruthenium, osmium, rhodium, and palladium.

11. The system of claim 9, the counter electrode material including graphite.

12. The system of claim 9, the counter electrode material including platinum.

13. The system of claim 9, the counter electrode material including platinized titanium.

14. The system of claim 9, the counter electrode material including niobium expanded mesh coated with platinum.

15. The system of claim 9, the container being plastic.

16. The system of claim 9 further comprising a pump operatively associated with the container.

17. A method of cleaning a hollow interior of a metal member comprising:

dc coupling the metal member to counter electrode material, the counter electrode material being in a container separate from the metal member and having a natural E° greater than a natural E° of the metal member;

passing an electrolyte having a substantially non-neutral pH through the container so as to contact the counter electrode therein; and passing the electrolyte from the container into the hollow interior of the metal member.

18. The method of claim 17 further comprising placing the counter electrode material in a plastic container.

19. The method of claim 17 further comprising selecting the counter electrode material from the group consisting of: graphite, nickel-base alloys, cobalt-base alloys, nickel-chromium-molybdenum alloys, platinum, platinized titanium, niobium expanded mesh coated with platinum, ruthenium, osmium, rhodium, and palladium.

20. The method of claim 17 further comprising selecting the counter electrode material to include graphite.

21. The method of claim 17 further comprising selecting the counter electrode material to include platinum.

22. The method of claim 17 further comprising selecting the counter electrode material to include platinized titanium.

23. The method of claim 17 further comprising selecting the counter electrode material to include niobium expanded mesh coated with platinum.

24. A method of cleaning a hollow interior of a metal member comprising:

providing a container housing counter electrode material having a natural E° greater than a natural E° of the metal member, the container having a fluid outlet;

dc coupling the metal member to the counter electrode material; and fluidicly coupling an electrolyte having a substantially non-neutral pH from within the container to the hollow interior of the metal member via the fluid outlet of the container.

25. The method of claim 24 wherein the container also has a fluid inlet, the method comprising fluidicly coupling the electrolyte from the hollow interior of the metal member to the container.

26. The method of claim 25 further comprising pumping the electrolyte.

27. The method of claim 24 further comprising providing a plastic container for the counter electrode material.

28. The method of claim 24 further comprising selecting the counter electrode material from the group consisting of: graphite, nickel-base alloys, cobalt-base alloys, nickel-chromium-molybdenum alloys, platinum, platinized titanium, niobium expanded mesh coated with platinum, ruthenium, osmium, rhodium, and palladium.

29. The method of claim 24 further comprising selecting the counter electrode material to include graphite.

30. The method of claim 24 further comprising selecting the counter electrode material to include platinum.

31. The method of claim 24 further comprising selecting the counter electrode material to include platinized titanium.

32. The method of claim 24 further comprising selecting the counter electrode material to include niobium expanded mesh coated with platinum.

33. A method of cleaning a passageway of a metal member comprising:

dc coupling the metal member to counter electrode material, the counter electrode material being in a container separate from the metal member and having a natural E° greater than a natural E° of the metal member;

passing an electrolyte having a substantially non-neutral pH through the container so as to contact the counter electrode material therein; and passing the electrolyte from the container into the passageway of the metal member.

34. The method of claim 33 further comprising placing the counter electrode material in a plastic container.

35. The method of claim 33 further comprising selecting the counter electrode material from the group consisting of: graphite, nickel-base alloys, cobalt-base alloys, nickel-chromium-molybdenum alloys, platinum, platinized titanium, niobium expanded mesh coated with platinum, ruthenium, osmium, rhodium, and palladium.

36. The method of claim 33 further comprising selecting the counter electrode material to include graphite.

37. The method of claim 33 further comprising selecting the counter electrode material to include platinum.

38. The method of claim 33 further comprising selecting the counter electrode material to include platinized titanium.

39. The method of claim 33 further comprising selecting the counter electrode material to include niobium expanded mesh coated with platinum.

40. A method of cleaning a passageway of a metal member comprising:

providing a container housing counter electrode material having a natural E° greater than a natural E° of the metal member, the container having a fluid outlet;

dc coupling the metal member to the counter electrode material in the container; and fluidicly coupling an electrolyte having a substantially non-neutral pH from within the container to the passageway of the metal member via the fluid outlet of the container.

41. The method of claim 40 wherein the container also has a fluid inlet, the method comprising fluidicly coupling the electrolyte from the hollow interior of the metal member to the container.

42. The method of claim 41 further comprising pumping the electrolyte.

43. The method of claim 40 further comprising providing a plastic container for the counter electrode material.

44. The method of claim 40 further comprising selecting the counter electrode material from the group consisting of: graphite, nickel-base alloys, cobalt-base alloys, nickel-chromium-molybdenum alloys, platinum, platinized titanium, niobium expanded mesh coated with platinum, ruthenium, osmium, rhodium, and palladium.

45. The method of claim 40 further comprising selecting the counter electrode material to include graphite.

46. The method of claim 40 further comprising selecting the counter electrode material to include platinum.

47. The method of claim 40 further comprising selecting the counter electrode material to include platinized titanium.

48. The method of claim 40 further comprising selecting the counter electrode material to include niobium expanded mesh coated with platinum.

* * * * *